US005573025A

United States Patent [19]

Atlas

[11] Patent Number: 5,573,025

[45] Date of Patent: Nov. 12, 1996

[54] CANE WITH ENGAGING MEMBER

[76] Inventor: Gerald D. Atlas, 2940 W. Balmoral, Chicago, Ill. 60625

[21] Appl. No.: 557,959

[22] Filed: Nov. 13, 1995

[51] Int. Cl.[6] ..... A45B 1/00

[52] U.S. Cl. ..... 135/65; 135/82; 135/75; 135/66; 248/689

[58] Field of Search ..... 248/107, 689; 135/65, 66, 67, 69, 75, 76, 82, 911

[56] References Cited

U.S. PATENT DOCUMENTS

| | | | |
|---|---|---|---|
| 1,329,915 | 2/1920 | McKenzie | 135/65 |
| 1,924,957 | 8/1933 | Orr | 135/66 X |
| 2,630,128 | 3/1953 | Slater | 135/69 |
| 2,674,253 | 4/1954 | Hopkins | 135/69 |
| 3,093,402 | 6/1963 | Sisson | 135/65 X |
| 3,289,685 | 12/1966 | Parker . | |
| 4,300,742 | 11/1981 | Hunn | 248/689 |
| 4,589,681 | 5/1986 | Erickson | 135/66 X |
| 4,794,743 | 1/1989 | Lehneis | 135/65 |
| 4,809,725 | 3/1989 | Champigny . | |
| 5,000,418 | 3/1991 | Vogt | 248/689 |
| 5,176,160 | 1/1993 | Osborn . | |
| 5,433,234 | 7/1995 | Lapere | 135/66 |
| 5,482,070 | 1/1996 | Kelly | 135/66 |

FOREIGN PATENT DOCUMENTS 295204 12/1899 France .

*Primary Examiner*—Wynn E. Wood

*Attorney, Agent, or Firm*—Marshall, O'Toole, Gerstein, Murray & Borun

[57] ABSTRACT

A cane has an engaging member for securing the cane to downwardly facing surfaces. The engaging member is attached to the shaft of the cane and is movable axially with respect to the shaft. Urging means is provided for urging the engaging member toward a top end of the shaft. When the engaging member is placed below a downwardly facing surface, the urging means urges the engaging member upwardly until a contacting surface of the engaging member contacts the downwardly facing surface. The urging means may comprise a coil spring.

23 Claims, 4 Drawing Sheets

CANE WITH ENGAGING MEMBER

BACKGROUND OF THE INVENTION

The present invention is directed generally to canes and other walking aids, and more particularly to a cane or other walking aid having structure for securing the cane or walking aid in a vertical disposition when not in use.

The convenience of a cane or other walking aid has been greatly limited by the lack of integral structure for supporting the walking aid when it is not in use. Although various cane securing devices have been produced before, these earlier devices were usually cumbersome and inconvenient to operate. One such securing device, disclosed in U.S. Pat. No. 5,000,418 to Vogt, is slidably attached to a cane shaft and requires the user manually to reposition or preset the securing device by initially sliding it to a height appropriate for the particular height of each different object to which the cane is to be secured. U.S. Pat. No. 4,300,742 to Hunn discloses a cane securing device which also requires the user manually to preset the device to a height which approximates the height of each object to which the cane is to be secured. In each of these prior art devices, the user of the walking aid had to estimate in advance the approximate height of each object to which the walking aid was to be secured and then manually preset the securing device for that height.

SUMMARY OF THE INVENTION

The above-described problems with the prior art devices are overcome by walking aids constructed in accordance with the present invention; there is no need to estimate the approximate height of each object to which the walking aid is to be secured and then manually preset the securing device for that height.

In one embodiment of the present invention, a walking aid such as a cane can be easily secured in a generally vertical orientation automatically by the employment of structure which secures the walking aid to a generally downwardly facing surface without having to preset the structure to the approximate height of the downwardly facing surface.

In another embodiment, the walking aid includes a shaft, a handle connected to the shaft near the top end of the shaft, an engaging member, and structure for mounting the engaging member for axial movement with respect to the shaft. The engaging member has a contacting surface facing toward a plane passing through the top end of the shaft for engaging the downwardly facing surface. There is a mechanism (e.g., a spring) for urging the engaging member toward the top end of the shaft. The engaging member can include an arm extending radially outwardly with respect to the shaft and having the aforementioned contacting surface which may be composed of a high friction material in order to increase friction between the contacting surface and the downwardly facing surface.

The engaging member may include a hollow cylinder and structure mounting the engaging member for axial movement with respect to the shaft. The urging mechanism typically comprises a coil spring mounted coaxially on the shaft, between the shaft and the hollow cylinder. A spring-retaining device, associated with the shaft and located below the top end of the spring, retains the spring against axial movement relative to the shaft, other than expansion and contraction of the spring.

In some embodiments of the walking aid, at least one coil spring is mounted coaxially on the shaft between the shaft and the hollow cylinder and below the spring retaining device. One such embodiment employs three coil springs located above the spring retaining device and two coil springs located below the spring retaining device.

The urging mechanism may include structure for urging the engaging member toward the top end of the shaft at all positions of the engaging member relative to the top end of the shaft.

One optional feature, when the walking aid is a cane, is a cavity in the bottom side of the cane handle and which can receive at least a portion of the arm extending from the engaging member when the engaging member is not being used to secure the cane.

Another such feature is a braking device for braking the upward movement of the engaging member before the arm contacts the cane handle. One braking device includes a sleeve located toward the top end of the shaft.

An alternative embodiment of the walking aid comprises a hollow cylinder having a top end and a longitudinally extending slot. A handle is connected to the hollow cylinder adjacent the top end and extends radially from the hollow cylinder. A spring is disposed in the hollow cylinder and a ring is on that end of the spring nearer the top end of the hollow cylinder. An arm attached to the ring extends radially through the slot of the hollow cylinder and has a contacting surface for securing the cane to a downwardly facing surface.

DETAILED DESCRIPTION OF THE PREFERRED EMBODIMENT

Figure 1:
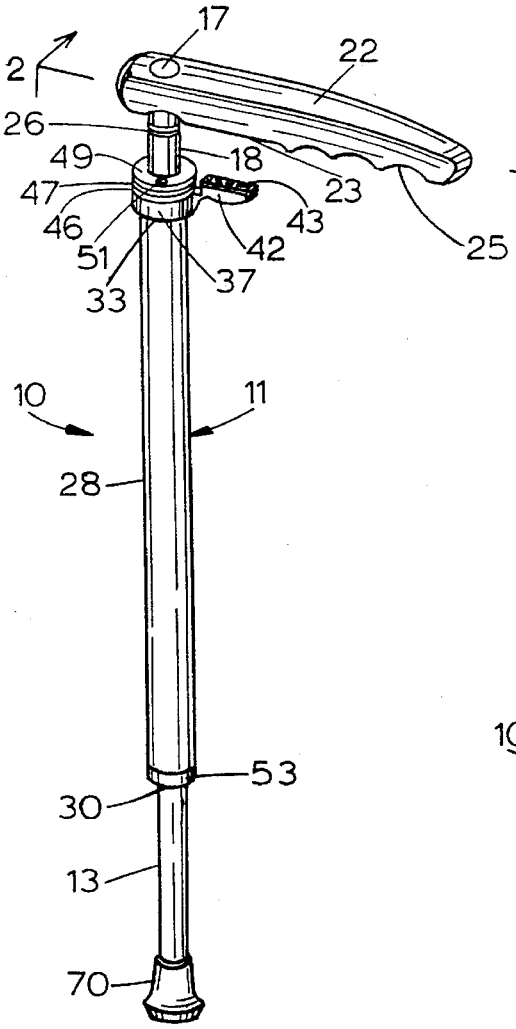
FIG. 1 is a perspective of a cane constructed in accordance with one embodiment of the present invention.

Referring initially to FIGS. 1–5, a cane, indicated generally at 10, has a vertically movable engaging member 11 mounted thereon. Cane 10 has a shaft 13 including a top portion 15, terminating at a top end 17, and a bottom end 19. A sleeve 18 is fixed on shaft 13 adjacent top portion 15. Attached to top portion 15 of shaft 13 is a handle 22 having a bottom 23 including finger grooves 25. Handle 22 has a passageway 67 for receiving top portion 15 of shaft 13.

Engaging member 11 includes a cylinder 28 having a bottom end 30 and a top end 33. Cylinder 28 is hollow and is mounted on shaft 13 for axial movement with respect to shaft 13. At bottom end 30 of cylinder 28 is an annular bushing 53.

Figure 3:
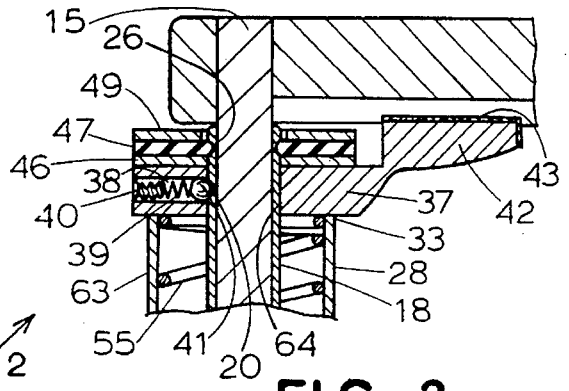
FIG. 3 is an enlarged, fragmentary sectional view of a portion of the embodiment of FIG. 2.
Figure 7:
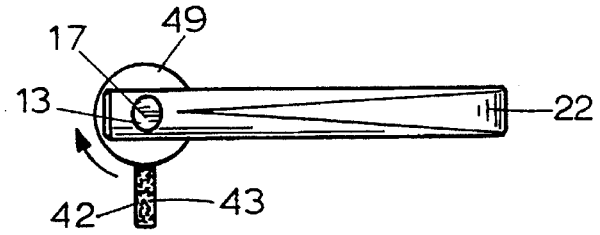
FIG. 7 is a top view of an embodiment of the cane.

Fixed to top end 33 of cylinder 28 is a ring 37, best shown in FIG. 3. Ring 37 has an arm 42 extending radially outwardly relative to shaft 13. Arm 42 has an upper contacting surface 43 facing toward a plane passing through top end 17 of shaft 13. Ring 37 and arm 42 are mounted for rotation with cylinder 28 about the axis of shaft 13 (FIG. 7).

Figure 2:
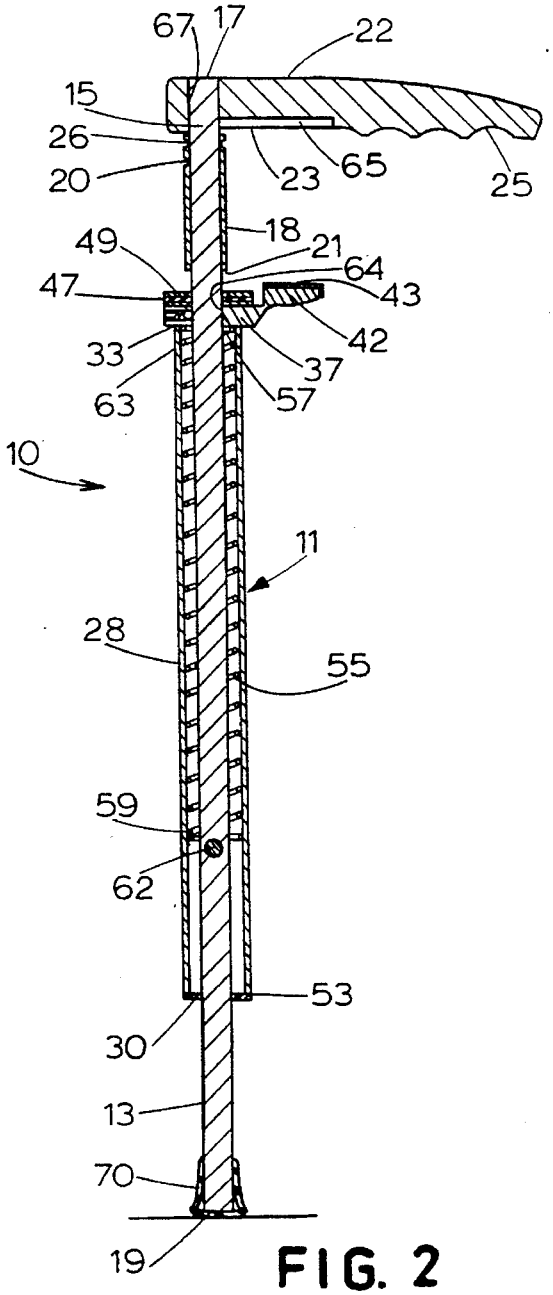
FIG. 2 is a sectional view of the cane of FIG. 1 taken along line 2—2.

A coil spring 55, shown in FIG. 2, is disposed in cylinder 28 for urging engaging member 11 toward top end 17 of shaft 13. Spring 55 has a top end 57 and a bottom end 59. A pin 62 is located adjacent bottom end 59 of spring 55 for retaining bottom end 59 of spring 55 in cylinder 28. Spring 55 is coaxially mounted on shaft 13.

Figure 4:
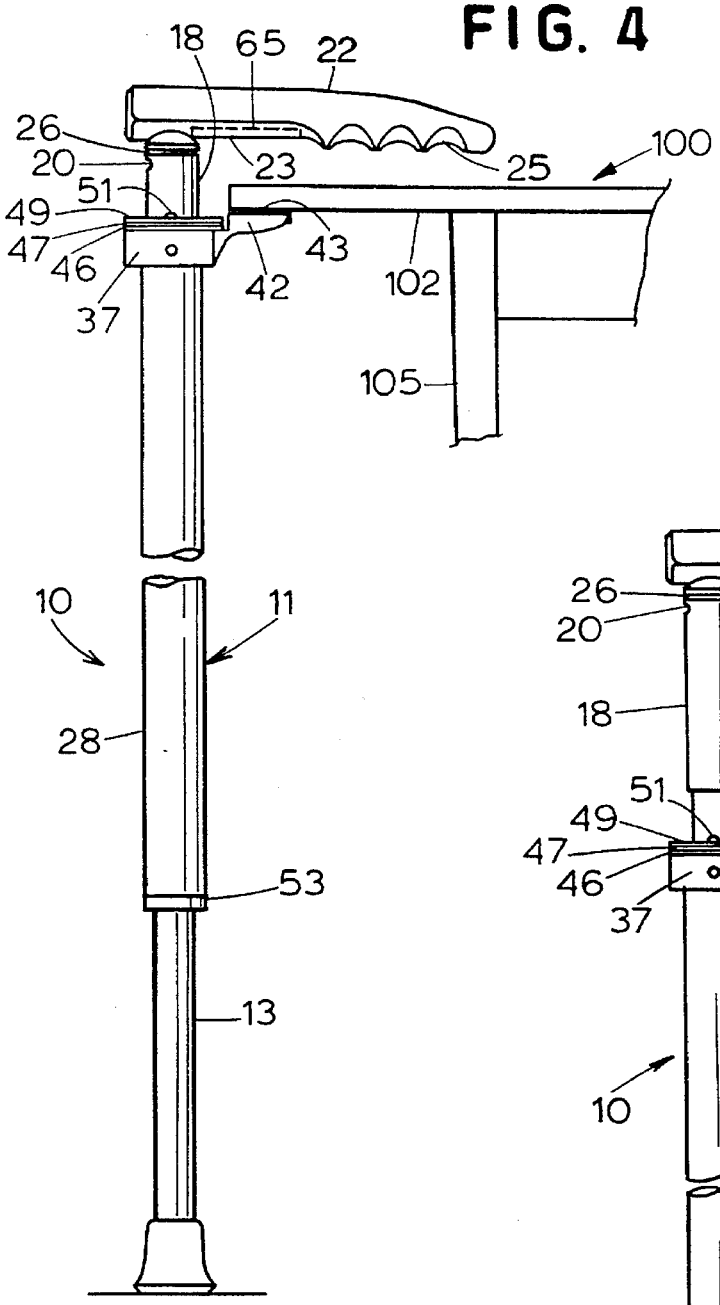
FIG. 4 is a side elevational view of the cane shown secured to a high tabletop.
Figure 5:
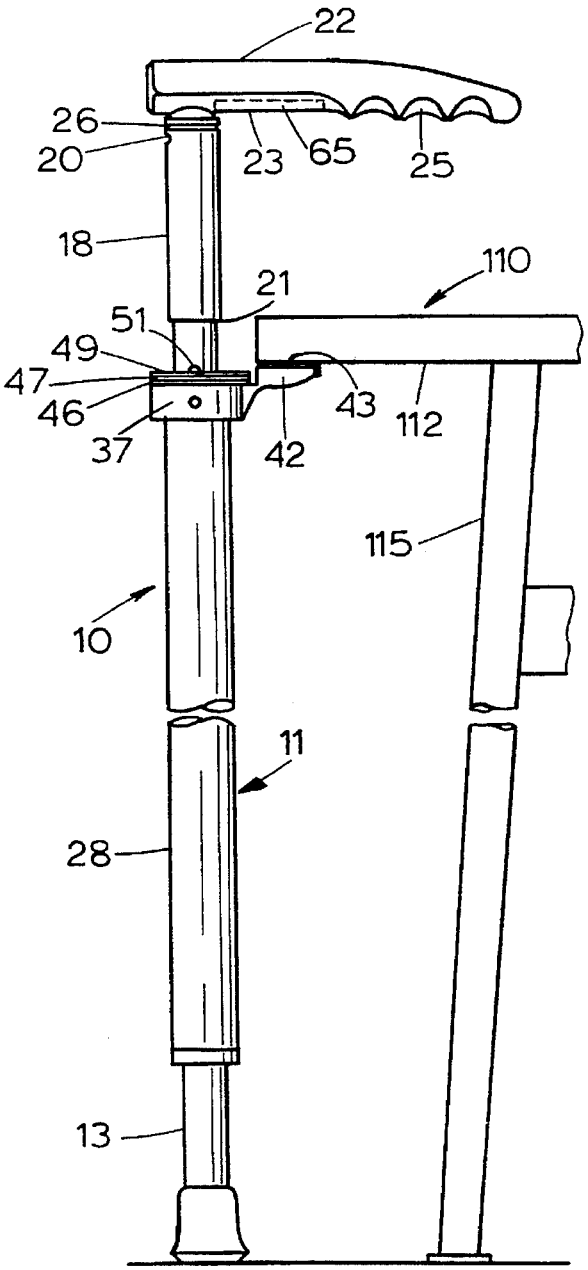
FIG. 5 is a side elevational view of the cane shown secured to a low tabletop.

FIG. 4 shows cane 10 secured to a table 100 having a downwardly facing surface 102 and a leg 105. Contacting surface 43 of arm 42 is in contact with downwardly facing surface 102 of table 100. FIG. 5 shows cane 10 secured to a table 110 having a downwardly facing surface 112 and a leg 115. Contacting surface 43 of arm 42 is in contact with downwardly facing surface 112 of table 110. Downwardly facing surface 112 depicted in FIG. 5 is a lower surface than downwardly facing surface 102 depicted in FIG. 4.

Cane 10 is secured to a downwardly facing surface such as surfaces 102, 112 when arm 42, urged upwardly by spring 55, moves upwardly and contacts the generally downwardly facing surface. To secure arm 42 to a downwardly facing surface, a user pulls downward on cylinder 28 or arm 42 until contacting surface 43 is lower than the downwardly facing surface. The user then positions arm 42 below the downwardly facing surface and releases either cylinder 28 or arm 42, whichever was being grasped. Spring 55 will then move engaging member 11 upwardly until arm 42 contacts the downwardly facing surface.

In some embodiments, spring 55 urges engaging member 11 toward top end 17 of shaft 13 at all vertical positions of engaging member 11 relative to the top of shaft 13. This is advantageous because it allows cane 10 to be secured to downwardly facing surfaces of many different heights without the user having to preset arm 42 to the specific height of each different surface.

As shown in FIG. 2, cane 10 is devoid of structure capable of stopping upward movement of engaging member 11 before engaging member 11 engages a downwardly facing surface such as surface 112 (FIG. 5) of table 110. Also, as shown in FIG. 2, handle 22 is fixed to shaft 13 so that the distance between handle 22 and bottom end 19 of shaft 13 remains constant during movement of engaging member 11 along shaft 13.

Spring 55 may be one spring, or a group of two or more springs. In the case of multiple springs, bottom 59 of spring 55 would correspond to the bottom of the lowest spring above pin 62. Top 57 of spring 55 would correspond to the top of the highest spring above pin 62.

Engaging member 11 can operate when attached to elongated objects other than canes, such as crutches. In many embodiments of the invention, the shape of handle 22 does not affect the operation of engaging member 11, so handle 22 is not necessary to secure cane 10 to a downwardly facing surface. Thus, a crutch having a handle contoured to provide support under an arm, rather than a handle to be grasped by a hand, can be secured to downwardly facing surfaces using the present invention. Similarly, engaging member 11 can operate when attached to a shaft 13 that is adjustable in length, such as a shaft adjustable by telescopic means.

In some embodiments handle 22 is not required to stop the vertical movement of arm 42 when cane 10 is not secured to a downwardly facing surface. A resting position of arm 42 is defined as the position of arm 42 with respect to top end 17 of shaft 13 when no force external to cane 10 acts on arm 42. To achieve a resting position of arm 42 which is near but not above top end 17 of shaft 13, a number of variables can be adjusted. These variables include the number of springs, the configuration of those springs with respect to pin 62, the relative lengths of the springs and the relative stiffnesses of the springs. Those skilled in the art can adjust those variables to achieve a desired resting position of arm 42 so that no handle 22 is necessary on top portion 15 of shaft 13 to keep arm 42 from advancing above top end 17 of shaft 13.

Spring 55 is prevented from sliding out of open top end 33 of cylinder 28 by any of a number of means. For example, a top end portion 63 of cylinder 28 may taper inwardly toward shaft 13. In such an embodiment, top end portion 63 of cylinder 28 retains top end 57 of spring 55. Alternatively, one may employ an annular member located on top end 33 of cylinder 28, overlapping top end 57 of spring 55, to perform the retaining function. Or, as pictured in FIG. 2, ring 37 inhibits top end 57 of spring 55 from protruding upwardly beyond cylinder 28.

Pin 62 retains bottom 59 of spring 55, preventing bottom 59 of spring 55 from moving downward when cylinder 28 is lowered. Pin 62 does not have to be located adjacent bottom 59 of spring 55. Instead, pin 62 can be positioned such that a portion of spring 55 is above pin 62 and a portion of spring 55 is below pin 62. In this fashion, spring 55 can function as both a spring above pin 62 (upper spring) and a spring below pin 62 (lower spring).

Sleeve 18 has an indent 20, a bottom end 21 and a circumferential groove 26 adjacent bottom 23 of handle 22. Atop ring 37 is a washer 46, a gasket 47 and retaining washer 49, all of which are attached to ring 37 by a screw 51 (FIG. 1). Gasket 47 cooperates with sleeve 18 to brake or stop the upward movement of engaging member 11 before arm 42 reaches bottom 23 of handle 22. During upward movement of engaging member 11, gasket 47 brakes engaging member 11 when gasket 47 contacts bottom end 21 of sleeve 18. If upward movement of engaging member 11 is slow enough, gasket 47 may be stopped at bottom end 21 of sleeve 18. If gasket 47 is urged upwardly above bottom end 21 of sleeve 18, gasket 47, which is resilient, will continue to produce friction against sleeve 18 as engaging member 11 moves upward. It is preferred that sleeve 18 have an outer diameter as close as possible to the diameter of shaft 13 so that gasket 47 can pass over sleeve 18 by just a slight external upward force applied to cylinder 28 or arm 42. In such a fashion the user can advance arm 42 along sleeve 18 and upwardly into contact with handle 22.

Referring to FIG. 3, ring 37 has a radial bore 38 that houses a spring 39. A set screw 40 secures spring 39 which biases a spherical bearing 41, preferably made of nylon, toward shaft 13. Spherical bearing 41 can engage indent 20 of sleeve 18 to help secure engaging member 11 in place at an uppermost position thereof adjacent top end 17 of shaft 13. When engaging member 11 has reached its uppermost position with respect to shaft 13, gasket 47 will be in groove 26, thereby additionally helping to secure engaging member 11 at this uppermost position. In place of gasket 47, a nylon ring having a serrated inner surface can also serve to brake engaging member 11 on sleeve 18 and to help secure engaging member 11 at its uppermost position.

To further secure engaging member 11 in the uppermost position, both retaining washer 49 and bottom 23 of handle 22 may be composed of a magnetic material. The magnetic sections will engage each other, securing ring 37 adjacent handle 22 to prevent engaging member 11 from moving downwardly along shaft 13 when engaging member 11 is not being used to secure cane 10 to a downwardly facing surface.

Another embodiment of a friction brake for engaging member 11 employs a circumferential groove on shaft 13 and which cooperates with gasket 47. In such a case, upon reaching the groove, gasket 47 would extend into and engage within the groove. For example, in FIG. 3, gasket 47 is shown to extend into and engage within groove 26 of sleeve 18. That same engaging mechanism would apply if groove 26 were located lower on shaft 13, in which case a lower groove 26 could be a friction brake operative when engaging member 11 moves either upwardly or downwardly. A circumferential groove for braking would preferably be sufficiently shallow so that gasket 47 could pass over the groove when just a slight external upward force is applied to cylinder 28 or arm 42.

Ring 37 comprises an inner surface 64 adjacent shaft 13. Inner surface 64 is preferably composed of a material, such as nylon, which provides smooth movement of engaging member 11 axially along shaft 13, but which also resists circumferential movement of ring 37 with respect to shaft 13. Resistance to circumferential movement helps arm 42 remain in a particular circumferential position, relative to shaft 13, corresponding to the position at which a user last arranged arm 42. More particularly, small circumferential forces subsequently applied unintentionally to cylinder 28 or arm 42 by the user, while lowering engaging member 11 along shaft 13, will not shift arm 42 circumferentially and, thus, will not require the user to reposition arm 42 circumferentially.

Bottom 23 of handle 22 has a cavity 65 which receives all or a portion of arm 42 when arm 42 rises to the height of bottom 23. Cavity 65 keeps arm 42 out of the way of the user when cane 10 is not being secured. Thus, when arm 42 is in cavity 65, arm 42 does not interfere with a user's grasping of handle 22, and arm 42 will not catch on objects such as closing doors or posts while the user walks with cane 10.

Figure 9:
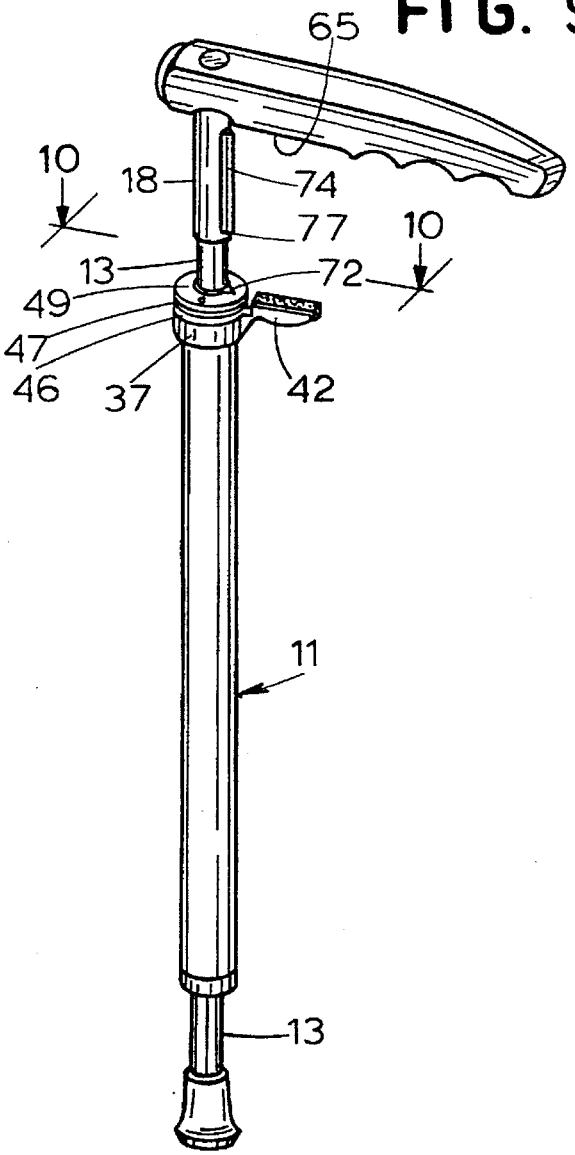
FIG. 9 is a perspective of a further embodiment of the present invention.
Figure 10:
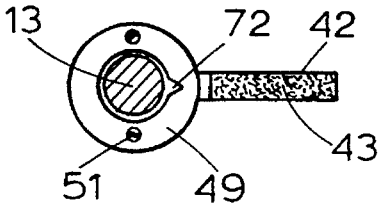
FIG. 10 is a sectional view of the cane of FIG. 9 taken along line 10—10.

A braking and alignment mechanism is shown in FIGS. 9 and 10. In this mechanism, a channel 72 extending parallel to the axis of shaft 13 is defined by a continuous indentation at the inner surface of each of ring 37, washer 46, gasket 47 and retaining washer 49. Sleeve 18 has a ridge 74 having a bottom end 77. When retaining washer 49 reaches bottom end 77 of ridge 74 during upward movement of engaging member 11, channel 72 receives ridge 74 only when channel 72 is circumferentially aligned with ridge 74. This brake is advantageous because, when ridge 74 and channel 72 are not aligned, this brake completely halts vertical movement of engaging member 11.

The braking and alignment mechanism of FIGS. 9 and 10 is also advantageous because arm 42 is aligned with cavity 65 in handle 22 when channel 72 is aligned with ridge 74. Thus, once a user has aligned channel 72 with ridge 74, arm 42 will advance upwardly into cavity 65, and the engagement of ridge 74 within channel 72 prevents arm 42 from being inadvertently circumferentially misaligned with cavity 65.

Contacting surface 43 of arm 42 can be composed of a high friction material such as textured plastic or rubber to increase the stability of cane 10 when cane 10 is secured to a downwardly facing surface.

On bottom end 19 of shaft 13, cane 10 may have a rubber pad 70 or any other conventional means for absorbing shock and preventing slippage.

Figure 6:
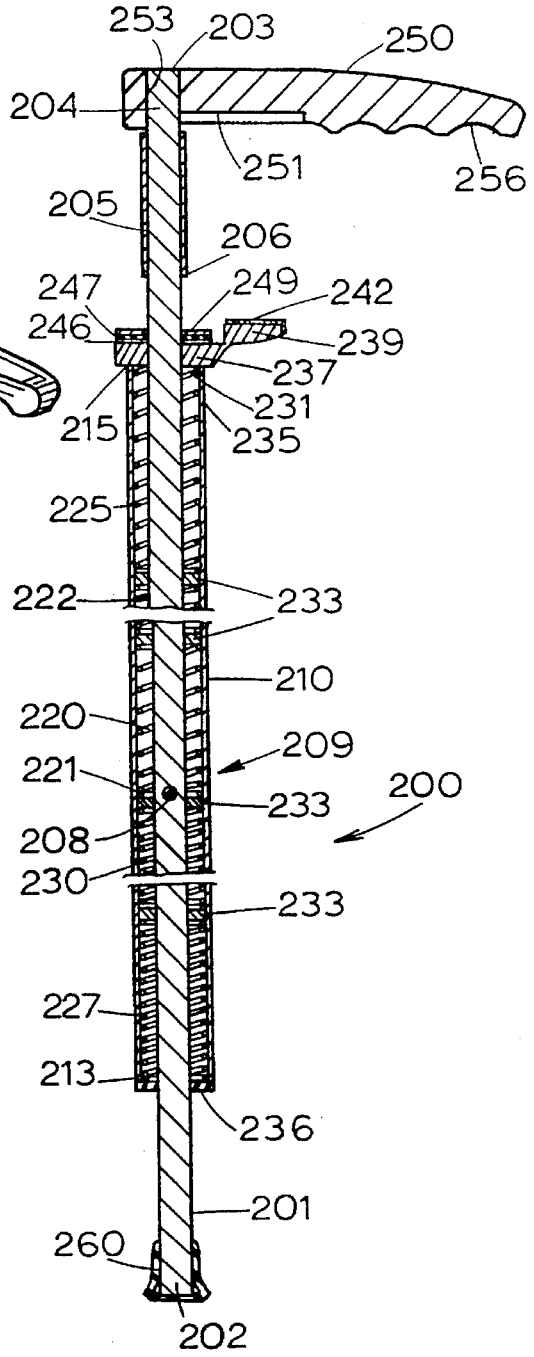
FIG. 6 is a vertical sectional view, similar to FIG. 2, of an alternative embodiment of the present invention.

Referring now to FIG. 6, another embodiment of the present invention is shown. In this embodiment, a cane designated generally at 200 has a shaft 201 with a bottom end 202 and a top portion 204 terminating at a top end 203. Beneath top end 203 is a sleeve 205 having a bottom end 206. An engaging member 209, including a hollow cylinder 210 having a bottom end 213 and a top end 215, is movably mounted coaxially on shaft 201 for axial movement with respect to shaft 201. Shaft 201 may be adjustable in length, such as by telescopic means, without interfering with the function of engaging member 209.

Cane 200 comprises a pin 208 extending through shaft 201. Mounted coaxially on shaft 201, between cylinder 210 and shaft 201, and above pin 208, are three upper coil springs: a bottom spring 220 having a bottom end 221, a middle spring 222 and a top spring 225 having a top end 231. Pin 208 supports bottom end 221 of spring 220 against downward movement with respect to shaft 201. Two lower coil springs, 227 and 230, are mounted coaxially on shaft 201 between cylinder 210 and shaft 201 and below pin 208. A washer 233 may be placed between each pair of adjacent springs to prevent the springs from overlapping.

Upper springs 220, 222, and 225 urge engaging member 209 toward top end 203 of shaft 201. Lower springs 227 and 230 brake engaging member 209 and absorb shock as engaging member 209 moves upwardly toward top end 203 of shaft 201. The braking and shock absorption accomplished by lower springs 227 and 230 help reduce the likelihood that a cane user's fingers will be pinched by arm 239 as engaging member 209 moves upward.

Fixed on top end 215 of cylinder 210 is a ring 237 having a radially extending arm 239. Ring 237 and arm 239 are mounted for rotation with cylinder 210 about the axis of shaft 201 in a similar fashion to the mounting of corresponding elements, comprising ring 37, arm 42, and cylinder 28, for rotation about shaft 13 in an embodiment discussed earlier and shown in FIG. 7. Arm 239 has a contacting surface 242 facing toward a plane passing through top end 203 of shaft 201 and composed of a high friction material.

Ring 237 corresponds to ring 37 in the embodiment of FIGS. 1–3. Mounted atop ring 237 and disposed around shaft 201 are a washer 246, a gasket 247 and a retaining washer 249. These correspond to washer 46, gasket 47 and retaining washer 49 in the embodiment shown in FIGS. 1–3. Gasket 247 is resilient and brakes engaging member 209 when gasket 247 contacts sleeve 205. If engaging member 209 is moving slowly enough, gasket 247 may stop the progress of engaging member 209 when gasket 247 encounters bottom end 206 of sleeve 205.

A circumferential groove in shaft 201 can also operate as a brake in conjunction with gasket 247. Such a brake was discussed in connection with gasket 47 in the embodiment shown in FIGS. 1–3.

As shown in FIG. 6, cane 200 is devoid of structure capable of stopping upward movement of engaging member 209 before engaging member 209 engages a downwardly facing surface such as surface 112 (FIG. 5) of table 110. Also, as shown in FIG. 6, handle 250 is fixed to shaft 201 so that the distance between handle 250 and bottom end 202 of shaft 201 remains constant during movement of engaging member 209 along shaft 201.

Ring 237 may have a radial bore in which a spring is housed for biasing a spherical bearing against shaft 201.

Such a configuration was described above for the embodiment shown in FIG. 3, in which spring 39, housed in radial bore 38 and secured by set screw 40, biases spherical bearing 41 against indent 20 of sleeve 18. In a similar manner, one may secure arm 239 adjacent a cane handle 250 when cane 200 is not secured to a downwardly facing surface.

Arm 239 can be further secured adjacent handle 250 by constructing retaining washer 249 and the bottom of handle 250 of magnetic material.

The inner surface of ring 237, adjacent shaft 201, is preferably composed of material, such as nylon, for reasons discussed above in connection with ring 37 shown in FIGS. 1–3.

Handle 250 is connected to top portion 204 of shaft 201, has a cavity 251 for receiving all or part of arm 239 and comprises finger grooves 256. Handle 250 also has a passageway 253, for receiving top portion 204 of shaft 201. A rubber pad 260 is connected to bottom end 202 of shaft 201.

Referring again to the springs in cane 200, preferably, there are three upper and two lower springs. An embodiment having only one upper spring, for urging engaging member 209 upwardly, and one lower spring, can have many of the advantages of the five-spring embodiment of FIG. 6, depending on the length and stiffness of the lower spring compared to the upper spring.

A washer 233 may be employed for separating each of upper springs 220, 222, 225 from the others and for separating each of lower springs 227, 230 from the other. Additionally, washer 233 may be placed near pin 208 to assist pin 208 in separating upper springs 220, 222, 225 from lower springs 227, 230. Preferably, washer 233 is composed of nylon or other plastic.

Upper springs 220, 222, 225 are prevented from sliding out of top end 215 of cylinder 210 by any of a number of means. For example, one may taper a top end portion 235 of cylinder 210 inwardly toward shaft 201. In such an embodiment, top end portion 235 of cylinder 210 engages top end 231 of spring 225. Alternatively, as pictured in FIG. 6, ring 237 retains spring 225. Lower springs 227, 230 are retained at bottom end 213 of cylinder 210 by a lower annular plate 236 fixed to cylinder 210.

Pin 208 prevents bottom end 221 of upper spring 220 from sliding below pin 208. Upper springs 220, 222, 225 are compressed when engaging member 209 is pushed down. It is this compression of upper springs 220, 222, 225 which causes engaging member 209 to be urged upward. Upon release of engaging member 209, upper springs 220, 222, 225 cause engaging member 209 to move upwardly until contacting surface 242 of arm 239 contacts a downwardly facing surface such as surfaces 102 or 112 shown in FIGS. 3 and 4. It is preferred that engaging member 209 is urged toward top end 203 of shaft 201 from all vertical positions of engaging member 209 along shaft 201 so that cane 200 can be secured to downwardly facing surfaces of many different heights without the user having to preset arm 239 to the specific height of each different surface.

As previously noted, lower springs 227, 230 help brake engaging member 209 and provide shock absorption during upward movement of engaging member 209. Braking and shock absorption are accomplished by the downward force which lower springs 227, 230 apply to engaging member 209 as lower springs 227, 230 are compressed. Lower springs 227, 230 are compressed by upward movement of engaging member 209. Additionally, the downward force from lower springs 227, 230 lessens the force required by a user to initially lower engaging member 209. This is helpful when the user wishes to lower contacting surface 242 of arm 239 below a downwardly facing surface 102 or 112. It is advantageous for lower springs 227, 230 to be in compression for much or all of the axial distance which engaging member 209 can move so that the braking, shock absorption, and other benefits of compressed lower springs 227, 230 are always or nearly always occurring.

The placement of pin 208 with respect to handle 250 depends on the stiffness of the spring or springs in cylinder 210. In one embodiment, pin 208 is positioned so that upper springs 220, 222, 225 are still slightly compressed even when arm 239 has reached handle 250. In that embodiment, arm 239 is urged upwardly at all axial positions of arm 239 along shaft 201, making arm 239 easy to secure to downwardly facing surfaces of a variety of heights. Further, pin 208 is preferably positioned so that lower springs 227, 230 are at least slightly compressed for the entire axial distance through which engaging member 209 moves, in order to facilitate braking, shock absorption, and downward movement of arm 239.

Pin 208 does not have to be located between springs in a multiple spring embodiment. Instead, pin 208 can be positioned such that a portion of a particular spring is above pin 208 and a portion of that same spring is below pin 208. In this fashion, it is possible to have a single spring, such as spring 230, function as both an upper spring and a lower spring.

In some embodiments, handle 250 is not necessary to stop the vertical movement of arm 239 when cane 200 is not being secured to a downwardly facing surface. This was discussed above regarding handle 22 of the embodiment shown in FIGS. 1–3. Those skilled in the art can adjust variables such as the length of the springs and the configuration of the springs with respect to pin 208 to achieve a desired resting position of arm 239, below top end 203 of shaft 201, at which the springs no longer urge arm 239 axially upwardly along shaft 201.

Sleeve 205 can slow or even stop the upward movement of engaging member 209 before arm 239 reaches handle 250. Another way to brake engaging member 209 is a circumferential groove located on shaft 201, in place of sleeve 205, at the location of sleeve 205. The braking operation of gasket 247 with either sleeve 205 or the circumferential groove is the same as the braking operation of gasket 47 with either sleeve 18 or the circumferential groove in the embodiment shown in FIG. 2, discussed earlier. Also, the braking accomplished when gasket 247 contacts bottom end 206 of sleeve 205 is the same as the braking discussed earlier for the embodiment shown in FIG. 2 in which gasket 47 cooperates with bottom end 21 of sleeve 18 to brake or stop engaging member 11. It is preferred that sleeve 205 have an outer diameter as close as possible to the diameter of shaft 201 so that gasket 247 can pass over sleeve 205 by just a slight external upward force applied to cylinder 210 or arm 239. In such a fashion, the user can advance arm 239 along sleeve 205 and upwardly into contact with handle 250.

A braking and alignment mechanism can comprise a sleeve 205 having a ridge parallel to the axis of shaft 201, and a channel defined by a continuous indentation at the inner surface of each of ring 237, washer 246, gasket 247 and retaining washer 249. Such a mechanism was discussed earlier in connection with the embodiment shown in FIGS. 9 and 10. Sleeve 205, ring 237 and retaining washer 249 correspond to, respectively, sleeve 18, ring 37 and retaining washer 49 of that embodiment.

Figure 8:
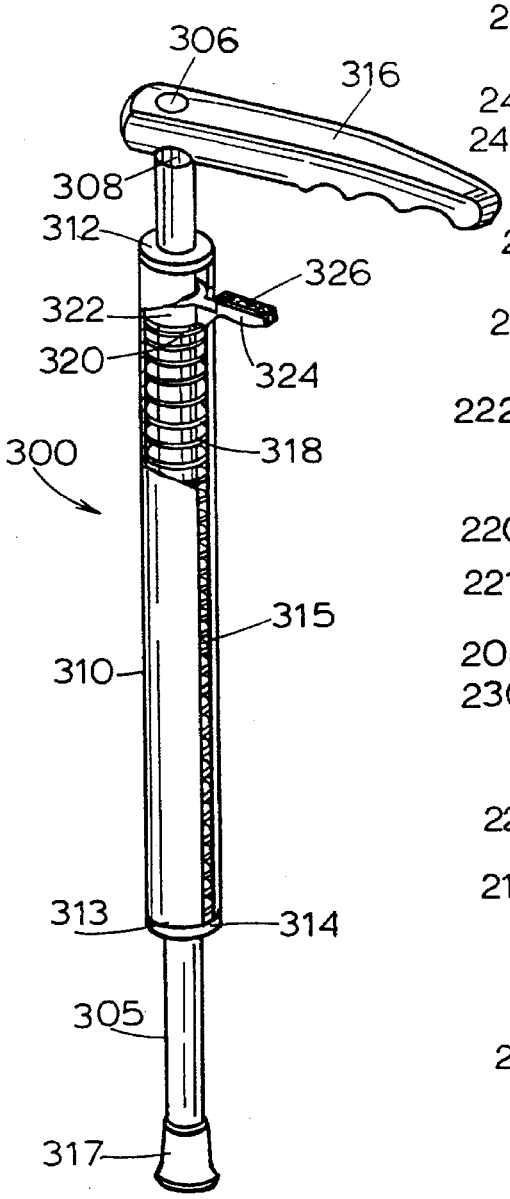
FIG. 8 is a perspective, partially broken away, of another embodiment of the present invention.

FIG. 8 shows an alternative embodiment of the present invention comprising a cane indicated generally at 300 and comprising a shaft 305 with a top portion 308 terminating at a top end 306. A handle 316 is attached to top portion 308 of shaft 305, and there is a rubber pad 317 on the bottom end of shaft 305. A hollow, elongated cylinder 310, having an upper annular end plate 312 and a bottom end 313, is immovably mounted around shaft 305. An annular plate 314 is located at cylinder bottom end 313, and a slot 315 runs along the length of cylinder 310 between bottom plate 314 and upper plate 312. Housed within cylinder 310 is a spring 318 having a top end 320. A ring 322, positioned on top end 320 of spring 318, has an arm 324 extending radially through slot 315. Arm 324 has a contacting surface 326. Spring 318 urges ring 322 upwardly toward upper plate 312 of cylinder 310.

Shaft 305 adds stability because it is solid and runs the length of cane 300. In an embodiment without shaft 305, cylinder 310 could extend from rubber pad 317 to handle 316 of cane 300, in which case handle 316 would be connected to upper plate 312 of cylinder 310 and would extend radially therefrom.

Plate 314 supports the bottom of spring 318 (or the bottom of the lowest spring in multiple spring embodiments), and retains the spring against downward movement with respect to cylinder 310. Alternatively, spring 318 may be retained by providing cylinder 310 with a bottom portion which tapers inwardly toward shaft 305. Alternatively, a pin (not shown) connected to either shaft 305 or an interior surface of cylinder 310 can retain the bottom of spring 318.

Because there is no movable cylinder on the exterior of the embodiment of FIG. 8, the user must press directly down on arm 324 to lower contacting surface 326 beneath a downwardly facing surface. When arm 324 is pressed downwardly, spring 318 in cylinder 310 compresses against plate 314. When arm 324 is released, spring 318 urges arm 324 to move upwardly until either contacting surface 326 contacts a downwardly facing surface, or ring 322 abuts upper annular end plate 312 of cylinder 310, or ring 322 reaches a braking mechanism (not pictured in this embodiment), whichever is reached first.

As discussed above in connection with corresponding elements in previous embodiments, contacting surface 326 may be composed of a high friction material, handle 316 may have a cavity to receive at least a portion of arm 324, and either a sleeve or circumferential groove on shaft 305 may be employed to brake ring 322.

While this invention has been described in connection with preferred embodiments thereof, it is obvious that modifications and changes therein may be made by those skilled in the pertinent art without departing from the spirit and scope of the invention. For example, springs for urging the engaging members may be disposed in hollow members having cross-sections other than the annular cross-section of a hollow cylinder.

I claim:

1. In combination:

a walking aid;

and means for securing said walking aid in a vertical disposition to a downwardly facing surface without having to preset said securing means to the approximate estimated height of said downwardly facing surface, said securing means comprising an engaging member and means for moving the engaging member upwardly from a position below said downwardly facing surface until engaged with said downwardly facing surface;

said walking aid being devoid of structure capable of stopping upward movement of said securing means before said securing means engages said downwardly facing surface.

2. A walking aid adapted to be secured to a downwardly facing surface, said walking aid comprising:

a shaft having a bottom end and a top end portion terminating at a top end;

a handle attached to said shaft at said top end portion and spaced from said bottom end;

an engaging member having a contacting surface facing toward a plane passing through the top end of the shaft;

means mounting said engaging member for axial movement with respect to the shaft without changing the spacing between the handle and the bottom end of the shaft; and means normally urging the engaging member upwardly toward the top end of the shaft until the contacting surface is engageable with the downwardly facing surface.

3. The walking aid of claim 2 wherein the urging means comprises a spring.

4. The walking aid of claim 2 wherein:

the engaging member comprises an arm extending radially outwardly relative to said shaft; and the contacting surface on the engaging member is a surface on said arm.

5. A cane which can be secured to a downwardly facing surface, said cane comprising:

a shaft having a bottom end and a top end portion terminating at a top end;

a handle attached to said shaft at said top end portion;

an engaging member comprising a hollow cylinder;

means mounting said engaging member for axial movement with respect to said shaft;

a contacting surface associated with said hollow cylinder and facing toward a plane passing through the top end of the shaft;

a coil spring mounted coaxially on the shaft and disposed in the hollow cylinder between the hollow cylinder and the shaft;

said spring having a top end relatively close to the top end of the shaft and a bottom end relatively remote from the top end of the shaft; and means, associated with the shaft and located below the top end of the spring, for retaining the spring against axial movement, relative to the shaft, other than expansion and contraction of the spring;

said spring comprising means normally urging said cylinder upwardly without urging said handle upwardly until said contacting surface contacts the downwardly facing surface.

6. The cane of claim 5 wherein:

said spring comprises means for urging the engaging member toward the top end of the shaft at all positions of the engaging member relative to the top end of the shaft.

7. The cane of claim 5 wherein said contacting surface is composed of a high friction material.

8. The cane of claim 5 and comprising:

a lower coil spring mounted coaxially on the shaft below the retaining means and between the shaft and the cylinder.

9. The cane of claim 5 wherein said coil spring is a first spring and said cane further comprises:

two upper coil springs mounted coaxially on the shaft and disposed in the cylinder between the shaft and the cylinder, said two upper springs being located above said first spring; and two lower coil springs mounted coaxially on the shaft between the shaft and the cylinder, said lower springs being located below the retaining means.

10. The cane of claim 9 and further comprising a washer between two adjacent coil springs.

11. The cane of claim 5 wherein:

the engaging member comprises an arm extending radially from the cylinder;

said contacting surface is a surface of said arm; and said handle has a cavity for receiving at least a portion of the arm.

12. The cane of claim 11 wherein the cavity receives all of the arm.

13. The cane of claim 5 and comprising:

means for braking said engaging member.

14. The cane of claim 13 wherein said braking means comprises a sleeve on said shaft.

15. The cane of claim 5 wherein:

said shaft comprises a sleeve having an indent; and said engaging member comprises means for engaging said indent.

16. The cane of claim 5 wherein:

said shaft comprises a sleeve having a ridge parallel to the axis of the shaft; and said engaging member comprises means for receiving said ridge.

17. A cane which can be secured to a downwardly facing surface, said cane comprising:

a hollow cylinder having a top end portion terminating at a top end and a longitudinally extending slot;

a handle extending radially in relation to said hollow cylinder and adjacent the top end thereof;

a spring disposed in the hollow cylinder, said spring having a pair of opposite ends;

a ring on that end of the spring which is nearer the top end of the hollow cylinder; and an arm connected to the ring and extending radially therefrom through said slot in the hollow cylinder;

said arm comprising a contacting surface for securing the cane to downwardly facing surfaces.

18. The cane of claim 17 wherein said handle has a cavity for receiving at least a portion of the arm.

19. The cane of claim 17 wherein:

said contacting surface comprises a top surface of the arm and is composed of a high friction material.

20. The cane of claim 17 and further comprising:

braking means for braking the engaging member.

21. A cane which can be secured to a downwardly facing surface, said cane comprising:

a shaft having a bottom end and a top end portion terminating at a top end;

a handle attached to said shaft at said top end portion;

an engaging member comprising a hollow cylinder;

means mounting said engaging member for axial movement with respect to said shaft;

a contacting surface associated with said hollow cylinder and facing toward a plane passing through the top end of the shaft;

a coil spring mounted coaxially on the shaft and disposed in the hollow cylinder between the hollow cylinder and the shaft;

said spring having a top end relatively close to the top end of the shaft and a bottom end relatively remote from the top end of the shaft;

means, associated with the shaft and located below the top end of the spring, for retaining the spring against axial movement, relative to the shaft, other than expansion and contraction of the spring; and a lower coil spring mounted coaxially on the shaft below the retaining means and between the shaft and the cylinder.

22. A cane which can be secured to a downwardly facing surface, said cane comprising:

a shaft having a bottom end and a top end portion terminating at a top end;

a handle attached to said shaft at said top end portion;

an engaging member comprising a hollow cylinder and an arm extending radially from the hollow cylinder;

means mounting said engaging member for axial movement with respect to said shaft;

a contacting surface on said arm of the hollow cylinder and facing toward a plane passing through the top end of the shaft;

said handle having a cavity for receiving at least a portion of the arm;

a coil spring mounted coaxially on the shaft and disposed in the hollow cylinder between the hollow cylinder and the shaft;

said spring having a top end relatively close to the top end of the shaft and a bottom end relatively remote from the top end of the shaft; and means, associated with the shaft and located below the top end of the spring, for retaining the spring against axial movement, relative to the shaft, other than expansion and contraction of the spring.

23. The cane of claim 22 wherein the cavity receives all of the arm.

* * * * *